US006820833B1

(12) United States Patent
Carlsson et al.

(10) Patent No.: US 6,820,833 B1
(45) Date of Patent: Nov. 23, 2004

(54) METHOD FOR CONTROLLING A YARN PROCESSING SYSTEM AND A YARN PROCESSING SYSTEM

(75) Inventors: Magnus Carlsson, Vegby (SE); Lars Helge Gottfrid Tholander, Haverdal (SE)

(73) Assignees: Ingenjoersfirman Elektroteknik IETV AB, Vegby (SE); IROPA AG, Baar (CH)

( * ) Notice: Subject to any disclaimer, the term of this patent is extended or adjusted under 35 U.S.C. 154(b) by 0 days.

(21) Appl. No.: 10/070,323

(22) PCT Filed: Sep. 1, 2000

(86) PCT No.: PCT/EP00/08565

§ 371 (c)(1),
(2), (4) Date: Aug. 26, 2002

(87) PCT Pub. No.: WO01/17886

PCT Pub. Date: Mar. 15, 2001

(30) Foreign Application Priority Data

Sep. 3, 1999 (DE) ..... 199 42 121

(51) Int. Cl.[7] ..... B65H 51/20; B65H 59/04

(52) U.S. Cl. ..... 242/364.7; 242/421.1; 242/421.8; 242/420.5; 242/420.6

(58) Field of Search ..... 242/364.7, 364.8, 242/365.1, 365.2, 418, 421.1, 421.4, 421.5, 421.6, 421.7, 421.8, 422.2; 139/452

(56) References Cited

U.S. PATENT DOCUMENTS

| | | | | |
|---|---|---|---|---|
| 3,164,333 A | * | 1/1965 | Robertson | 242/421.6 |
| 4,986,316 A | * | 1/1991 | Morohashi et al. | 139/452 |
| 5,069,395 A | | 12/1991 | Krumm | |
| 5,385,310 A | * | 1/1995 | Tholander | 242/418 |

FOREIGN PATENT DOCUMENTS

| | | |
|---|---|---|
| EP | 0396902 A1 | 11/1990 |
| EP | 0863236 A1 | 9/1998 |
| FR | 2 690 910 | 11/1993 |

* cited by examiner

*Primary Examiner*—Kathy Matecki
*Assistant Examiner*—Scott J. Haugland
(74) *Attorney, Agent, or Firm*—Flynn, Thiel, Boutell & Tanis, P.C.

(57) ABSTRACT

The invention relates to a method for controlling a yarn processing system comprising a textile machine, a yarn feed device and a supply spool. According to the inventive method, the yarn feed device pulls the yarn from the supply spool with varying speed and forms and maintains a yarn intermediate store. In addition, a rotatable supply spool (B) is turned at least by the yarn tension elicited by the winding drive (4) of the yarn feed device (F), and the yarn (Y) is tangentially removed from the supply spool (B).

18 Claims, 2 Drawing Sheets

METHOD FOR CONTROLLING A YARN PROCESSING SYSTEM AND A YARN PROCESSING SYSTEM

FIELD OF THE INVENTION

The invention relates to a method for controlling a yarn processing system and a yarn processing system. "Yarn" is intended to comprise not only conventional textile or synthetic yarn material, but predominantly a longitudinally extending substrate of high tensile strength like a tension resistant carbon or aramid fibre, a metal wire, or the like.

BACKGROUND OF THE INVENTION

For the production of functional reinforcement, fabric yarn material is processed which is tension resistant and optionally apt to stand high loads. For example, for filtering or bossing fabric webs used in paper and cardboard machines, W warn material is woven having very high tension resistance. Significant problems occur when handling such yarn materials in a conventional manner between the supply spool and the yarn feeding device with overhead yarn release from the supply spool.

It is an object of the invention to provide a method of the kind as mentioned above as well as a yarn processing system which allows processing of yarn material of particular tensile strength and extreme strength without problems.

According to the method of the invention, problems otherwise occurring due to an overhead release of the yarn from the supply spool are eliminated by tangentially releasing the yarn from the supply spool. In this case the winding drive of the yarn feeding device is producing the yarn tension necessary for rotating the rotatably provided supply spool. The yarn enters the yarn feeding device properly and without twist as dictated by the rotation of the winding drive. The rotatably provided supply spool allows the winding drive to precisely release the yarn amount needed per time unit.

In accordance with the system features the rotatably journalled supply spool is positioned such that it allows a tangential release of the yarn by the yarn feeding device. The winding drive of the yarn feeding device is acting as a rotational drive for the supply spool since at least the yarn tension generated by the winding drive as well as the tensile strength of the yarn produce the torque necessary to rotate the supply spool. In this way the problems which otherwise result from the yarn properties are solved surprisingly simply.

Expediently additionally the rotational resistance of the supply spool is regulated actively. This is a significant feature of the method and considers the condition that the winding drive has to be accelerated relatively rapidly to a high speed and at the same time has to drag the supply spool with it, or has to be brought to a stand still relatively rapidly while then the supply spool tends to continue to rotate further. As a parameter for the regulation of the rotational resistance an essentially constant yarn tension can be used. Preferably, the regulation is carried out substantially in synchronism with speed variations of the winding drive. The winding drive provides the necessary rotation of the supply spool, but is assisted by the regulation of the rotational resistance of the supply spool. A respectively regulated decrease of the rotational resistance is felt by the winding drive as a relief. An additional conveying motion of the supply spool assists during acceleration of the winding drive. In case of a stoppage of the winding drive the rotational resistance of the supply spool is increased accordingly to avoid an after run of the supply spool.

Advantageously, the yarn tension is detected and then the rotational resistance of the supply spool is regulated in view of a reference yarn tension. The winding drive constantly fulfils a predetermined drive function for the supply spool. However, the winding drive may be assisted in its driving function in a positive or a negative sense, when the rotational resistance of the supply spool is regulated accordingly.

The rotational resistance of the supply spool can be decreased by active rotation of the supply spool, however, exclusively to a degree by which it is assured that the winding drive permanently has to pull, but that the yarn is not relaxed.

Particularly expediently the rotational resistance of the supply spool is increased by active braking of the supply spool to a stand still when the winding drive is switched off. In this way an after run of the supply spool is prevented. In order to constantly assure a determined basis yarn tension it is expedient to even bring the switched off winding drive by the yarn itself into a stand still condition by braking the supply spool.

The regulation of the rotational resistance of the supply spool either is carried out with the help of yarn sensor signals or by means of run or stop signals representing the current actuation of the winding drive, i.e. under consideration of the actuation current or a current free condition of the winding drive.

In a simple variant of the method, the rotational resistance of the supply spool is only varied between a free running condition in the rotational journalling of the supply spool and a complete stand still. The supply spool is stopped actively as soon as a yarn sensor signal occurs which results in the stop of the winding drive or when the actuation current of the winding drive is switched off.

In this case the supply spool expediently is brought to stand still with an adjustable deceleration in order to keep the mechanical loads of the yarn, the yarn feeding device and also the supply spool low.

When switching on the winding drive, a decrease of the rotational resistance of the supply spool can be controlled when switching on or even a little earlier.

In the system it is expedient to equip the supply spool with a device for varying its rotational resistance. The device then is responsible for the acceleration or the stoppage of the supply spool, respectively, in case that the winding drive in the yarn feeding device is not capable of carrying out these tasks. This may happen during acceleration of the supply spool, however, mainly is necessary when stopping the winding drive to stop the supply spool.

A slip rotational drive for the supply spool is capable of assisting the winding drive during release of the yarn without adjusting a perfect synchronism, and also is advantageous to decelerate the supply spool to stand still.

For that function the slip rotational drive should be switchable between a conveying operation mode and a braking operation mode.

Since the winding drive due to its additional function as a rotational drive for the supply spool does have a higher input power demand than was necessary for the normal operation of the yarn feeding device, the electromotor of the winding drive and the winding drive itself should be designed for higher power demands than for a normal, only consumption depending operation of the yarn feeding device.

A particularly simple embodiment of the system is using a controlled engageable and disengageable braking device for the supply spool as the device for varying its rotational resistance. In disengaged condition only the natural rotational resistance of the supply spool and its mass inertia are effective. When engaging the braking device the supply spool is braked, preferably to stand still, so that its after run is prevented when the winding drive has to stop.

For engaging the braking device expediently a maximum signal of a yarn sensor is used, or a stop signal of the motor, or a signal, respectively, which is derived from switching off the actuation current.

The braking device can be disengaged as soon as a minimum size signal is generated which also switches on the winding drive, or the run signal of the motor representing the start of the current actuation of the motor. However, it is possible, to disengage the braking device even significantly earlier, namely as soon as the winding drive and also the supply spool have stopped completely.

Expediently, the braking device is engaged with an adjustable deceleration in order to prevent excessive mechanical loads by a too early stoppage of the yarn when the winding drive still carries out an after run motion.

A structurally simple braking device is provided which includes a friction element acting on a braking element of the supply spool, which friction element is adjustable by a controlled driving device. For this function a pneumatic cylinder with or without a spring accumulator, a magnetic brake, an eddy current brake, or the like, may be employed.

Particularly expediently the run signal or stop signal, respectively, of the motor of the winding drive is detected without a galvanic connection and contactlessly by means of an external pick-up head which is positioned at the housing of the yarn feeding device such that it e.g. can detect the current actuation or the current free condition or the presence of a rotating motor magnet field, by using the usual insufficient shielding at such yarn feeding devices against exiting electromagnetic fields, or the like.

The system preferably is used for processing yarn material having high tensile strength like carbon fibres or the like processed for the production of functional reinforcing fabrics.

BRIEF DESCRIPTION OF THE DRAWINGS

Embodiments of the subject of the invention are explained with reference to the drawings, in which FIG. 1 schematically shows a side view of a yarn processing system.

DETAILED DESCRIPTION

Figure 1:
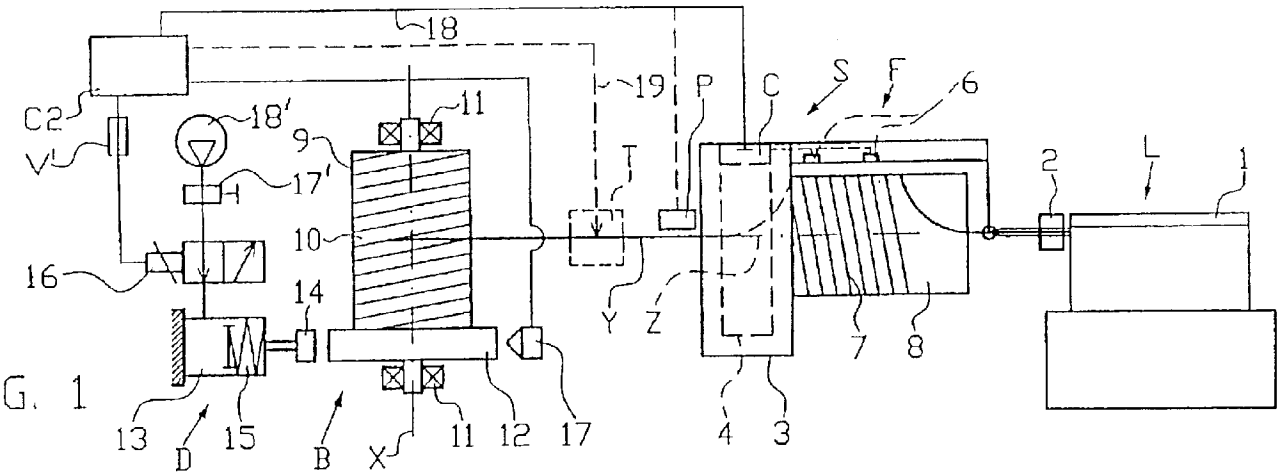

A yarn processing system S, particularly for processing yarn material having high tensile strength like carbon fibres or the like, comprises (FIG. 1) a textile machine L, which consumes a yarn Y, e.g. a weaving machine, a yarn feeding device F upstream of the textile machine L, and upstream of the yarn feeding device F and structurally separated from the yarn feeding device F a supply spool B for the yarn Y. A weaving shed 1 is provided in the textile machine L into which weft yarns are intermittently inserted by means of an insertion device 2. Said weft yarns are predetermined longitudinal sections of the yarn Y.

The yarn feeding device F has a winding drive 4 including an electromotor in a housing 3, the rotational speed, acceleration and deceleration or stand still of the electromotor being controlled by a control device C which is transmitting run and stop signals, respectively, to the motor. At least one yarn sensor 6 is provided in the yarn feeding device F, preferably a minimum-size yarn sensor and a maximum-size yarn sensor, each of which is surveying the size of a yarn store 7 formed on a storage body 8. The yarn sensors transmit signals to the control unit C as soon as the yarn store 7 reaches the maximum size or the minimum size. Reaching the maximum size results in response signals of the maximum size yarn sensor by which signals the control device C emits a stop signal for the winding drive 4 such that the actuation current of the winding drive 4 is switched off. The response signals of the minimum yarn size yarn sensor indicate the minimum yarn store size. By those signals the control device C emits a run signal to the motor of the winding drive 4 such that the actuation current is switched until the winding drive 4 accelerates. The axis of the yarn feeding device F is indicated by Z and corresponds with the direction along which the yarn feeding device F is pulling the yarn Y from supply spool B.

A spool body 9 of supply spool B carries a corresponding yarn supply 10. In the shown embodiment the spool body 9 is supported for free rotation by bearings 11. An axis X of spool body 9 is arranged essentially perpendicularly in relation to axis Z of the yarn feeding device F to allow release of the yarn tangentially from spool body 9. In this embodiment a flange-shaped braking element 12 is firmly connected to spool body 9. A friction element 14 of a device D for regulating the rotational resistance of the supply spool B is aligned with braking element 12. Device D is constituted by an adjustable brake 13 including a drive 15 for the friction element 14. The brake 13 can be adjusted between engaged and disengaged positions. Drive 15 may be a pneumatic cylinder which can be actuated pneumatically in both adjustment directions, or may be a pneumatic cylinder (spring accumulator cylinder) which is loaded in one adjustment direction by a return spring. In the example shown, drive 15 (pneumatic cylinder) is connected to a pressure source 18' via a solenoid valve 16. A pressure adjustment device 17' may be provided as well. Solenoid valve 16 can be switched between an open position and a venting position and is connected to a control device C2 or device D. A delaying member V' may be arranged in-between by which a signal emitted by control device C2, e.g. for engaging the braking device, can be delayed for a selectable duration.

A sensor 17 (e.g. an inductive sensor) is aligned with flange-shaped braking element 12 of supply spool B. Sensor 17 detects whether supply spool B is rotating or has stopped. Sensor 17 is connected to control device C2 in order to e.g. confirm at least the stand still condition of supply spool B. Furthermore, control device C2 is connected via a signal line 18 e.g. to control device C of yarn feeding device F. Along this line either signals of the yarn sensors 6 are transmitted to the control device C, or the stop or run signals, respectively, emitted for the electric drive motor of the winding drive 4.

Figure 4:
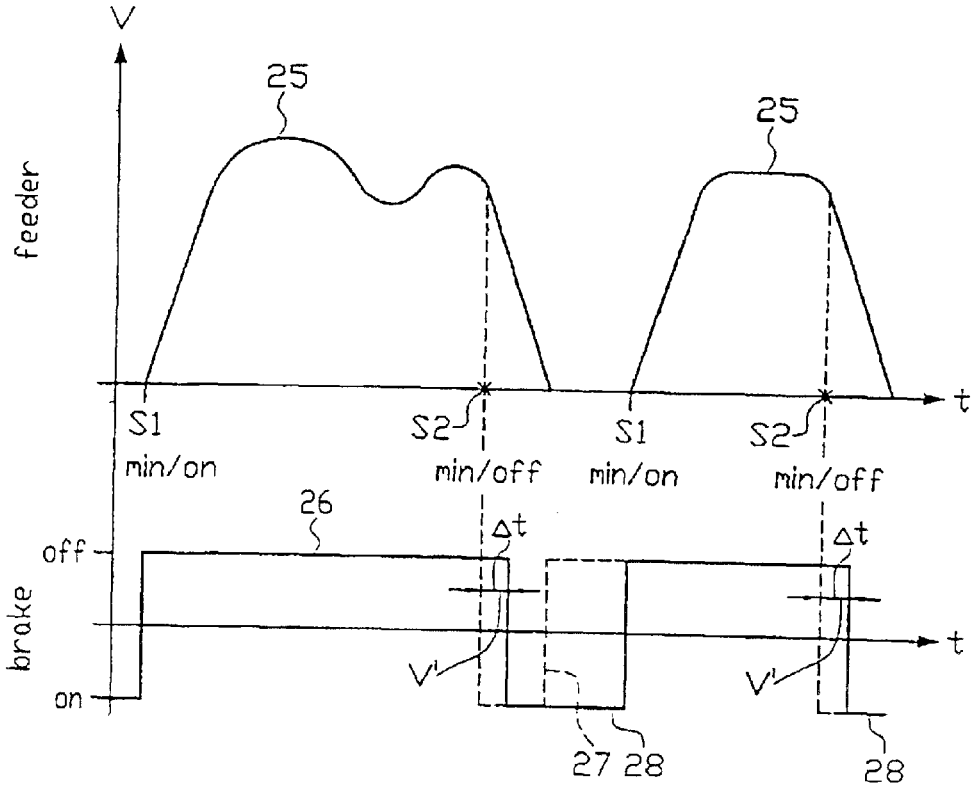
FIG. 4 is a speed/time diagram with an associated diagram depicting switching on and switching off conditions.

The processing system S in FIG. 1 e.g. is controlled in accordance with the diagrams shown in FIG. 4. Firstly, the supply spool B is stopped. The braking device still is engaged or already is disengaged. The winding drive 4 is stopped as well. The yarn store 7 has its maximum size. The textile machine L is starting to consume yarn Y. As soon as due to consumption the yarn store 7 reaches its minimum size, or even earlier, minimum size yarn sensor 6 transmits signals to control device C which in turn transmits a run signal to the electric drive motor of winding drive 4 and switches on the actuation current for the drive motor. If not done earlier, the braking device is now disengaged. The winding drive 4 accelerates quickly to replenish the yarn store 7. At the same time a yarn tension rises in the yarn Y. The yarn tension has an effect back to the supply spool B such that the tangentially released yarn Y rotates the supply spool B in synchronism with the yarn speed or the speed of the winding drive 4, respectively. As soon as the size of the yarn store 7 reaches maximum size yarn sensor 6 emits signals to the control device C until the control device C transmits a stop signal to the drive motor. The same stop signal also is processed in the control device C2 to engage the braking device. The response behaviour of the braking device and also the delay of deceleration member V' are adjusted such that the supply spool B is brought to a stand still at least as rapidly as the winding drive 4 stops. Preferably the winding drive 4 even is stopped by the yarn tension generated by braking the supply spool B.

As soon as both the supply spool B and the winding drive 4 have stopped, the braking device may be released again.

In FIG. 1 a control line 19 serves to monitor the yarn tension in the yarn Y between the supply spool B and the yarn feeding device F by a tensiometer T. The yarn tension measured alternatively or even additively may be used as a parameter for engaging or disengaging the braking device. In this case a separate connection to the control device C Is not necessary. As a further alternative a pick-up head P is shown in dotted lines which is connected to control device C by a line 18. The pick-up head P detects the currentless or current actuated condition of the drive motor and emits signals representing the respective condition. The pick-up head P detects the current free or current actuated condition of the drive motor without contact only from the exterior of the housing 3 of the yarn feeding device F, e.g. with the help of braking through magnetic fields.

The upper diagram in FIG. 4 shows the development of the speed V of the winding drive 4 over time t. The curve 25 shown in full lines indicate that upon occurrence of a minimum size signal or a run signal S1 for the drive motor the drive motor starts to run and upon occurrence of a maximum size signal or a stop signal S2, respectively, for the drive motor, the speed of the drive motor decreases to zero.

The lower diagram in FIG. 4 represents the control signals for the braking device, namely an on-signal 26 and an off-signal 28 which may be formed by respective different voltage levels. The lower diagram shows that the control signal for the braking device switches from the on-signal 28 to the off-signal 26 as soon as the run signal S1 Is emitted. As soon as the stop signal S2 for the drive motor occurs later, the off-signal again switches back to the on-signal 28, however, expediently with a delay V', to stop the supply spool B such that the latter reaches a stand still condition earlier than the winding drive 4 would reach its stand still condition alone. At 27 it is indicated in dotted lines that the off-signal 26 for the braking device is already present after a short time, namely prior to the occurrence of a new run signal S1. This happens expediently then when the supply spool and the winding drive reliably have stopped. Occasionally it may be sufficient to switch to the off-signal 26 first then when a new run signal S1 occurs. The next switch from the off-signal 26 to the on-signal 28 for the braking device is carried out exactly upon occurrence of the stop signal S2 for the drive motor, or again after the active delay V'.

Figure 2:
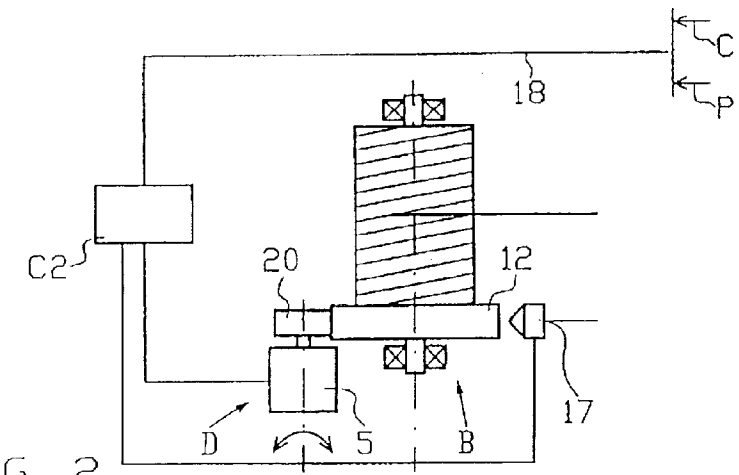
FIG. 2 is a detailed variant of the yarn processing system of FIG. 1.

The detail variant in FIG. 2 differs from the one of FIG. 1 in that the device D of the supply spool B is constituted such that it varies the rotational resistance of the supply spool B in a positive and/or a negative sense. The winding drive 4 has to overcome this rotational resistance to tangentially release the yarn Y. Device D here is formed as a slip rotational drive for supply spool B., i.e. a drive preferably operating with rotational slip e.g. with a reversible rotational drive 5, a friction roller 20, and the flange-shaped braking element 12, which in this case functions as a drive element or as a braking element, respectively. Device D actively assists winding drive 4. For example, a limited torque is applied to supply spool B in the conveying direction of the yarn, such that the winding drive 4 does not have to produce the entire torque alone which torque is necessary to rotate and/or accelerate the supply spool B. In this case the conveying torque of the device D may be maintained constant at a predetermined level or may even be adapted permanently to the speed profile or torque profile of the winding drive 4 during operation of the yarn feeding device F. For braking the supply spool B either rotational drive 5 is stopped or its sense of rotation is reversed, and the supply spool B is decelerated or braked, respectively, or is braked even to stand still. The control device C may be connected via control line 18 either with control device C or with the pick-up head P or even also with the tensiometer T. By the action of the slip drive e.g. a relatively uniform yarn tension profile can be produced and an active assistance of the winding drive 4 is carried out.

Figure 3:
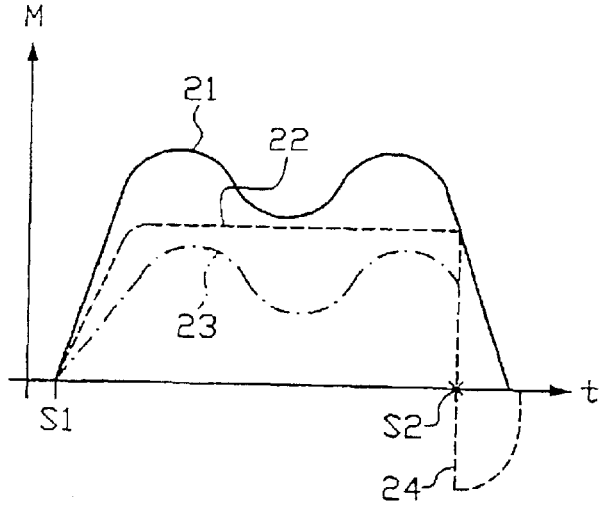
FIG. 3 is a torque/time diagram.

Full line curve 21 in the diagram of FIG. 3 shows the torque development in the yarn feeding device F. Dash-dotted curve 22 indicates that the device D first accelerates supply spool B to a predetermined torque level, that said torque level then is maintained, and that the torque is reduced and even a braking torque 24 is controlled upon occurrence of stop signal S2 for the drive motor of the winding drive. Dash-dotted curve 22 indicates that the torque development of device D is adapted to the torque development of curve 21, however, such that winding drive 4 permanently will generate a determined yarn tension which expediently never drops to zero. Furthermore, it is possible to adapt the speed and the acceleration as well as deceleration of the supply spool B exactly to the speed, the acceleration and the deceleration of the winding drive 4, in each case with a slight difference to constantly maintain a determined minimum yarn tension and not to relax the yarn completely at any time. Basically an arrangement is preferred wherein axis X essentially is located perpendicularly with respect to axis Z. In case that the yarn Y is deflected somewhat between the supply spool B and the yarn feeding device F, even other relative positions of the two axes might be possible. In any case it has to be assured that the yarn Y is taken off tangentially from supply spool B.

What is claimed is:

1. A method of controlling a yarn processing system including a yarn consuming textile machine, a yarn feeding device upstream of the textile machine, a rotatable supply spool upstream of the yarn feeding device and a control arrangement which controls a winding drive of the yarn feeding device and regulates the rotational resistance of the supply spool which must be overcome by the winding drive when withdrawing yarn from the supply spool, said method comprising the steps of:

pulling a yarn off of the supply spool with the winding drive with varying speed to form and maintain an intermediate yarn store which satisfies a yarn consumption demand of the textile machine at any time;

monitoring the size of the yarn store with a yarn sensor provided in the yarn feeding device;

controlling an actuation current for the winding drive with the control arrangement by generating run or stop signals for the winding drive based upon signals received from the yarn sensor; and actively regulating the rotational resistance of the supply spool substantially in synchronism with, speed variations of the winding drive based upon the yarn sensor signals or the run or stop signals with the control arrangement.

2. The method of claim 1, wherein said step of actively regulating includes increasing the rotational resistance of the supply spool by braking the supply spool to bring same to a stop when the winding drive is deactivated to prevent an after-run of the supply spool.

3. The method of claim 2, including stopping the deactivated winding drive with the yarn by said braking of the supply spool.

4. The method of claim 1, including detecting the yarn tension between the supply spool and the yarn feeder, and regulating the rotational resistance of the supply spool based upon a predetermined yarn tension.

5. The method of claim 1, including:

with the control arrangement, providing a stop signal to the winding drive and switching off an actuation current for the winding drive based upon a maximum signal provided by the yarn sensor, or providing a run signal to the winding drive and switching on the actuation current for the winding drive based upon a minimum signal provided by the yarn sensor; and said step of actively regulating is performed based upon one of: the minimum or maximum signal; and the run or stop signal.

6. The method of claim 1, wherein said step of actively regulating includes varying the rotational resistance of the supply spool between a free running condition and a stand still condition, and increasing the rotational resistance of the supply spool to achieve the stand still condition based upon a stoppage of the winding drive represented by one of: a maximum signal provided by the yarn sensor; a stop signal provided by the control arrangement to the winding drive; and a currentless condition of a drive motor of the winding drive.

7. The method of claim 6, wherein said step of increasing includes increasing the rotational resistance of the supply spool with an adjustable delay.

8. The method of claim 1, wherein said step of actively regulating includes decreasing the rotational resistance of the supply spool at the occurrence of one of: a minimum signal provided by the yarn sensor; and a run signal provided by the control arrangement to the winding drive to accelerate the winding drive.

9. The method of claim 1 wherein said step of actively regulating includes decreasing the rotational resistance of the supply spool prior to the occurrence of one of: a minimum signal provided by the yarn sensor; and a run signal provided by the control arrangement to the winding drive to accelerate the winding drive.

10. The method of claim 1, wherein said step of actively regulating includes driving said supply spool in a yarn conveying direction.

11. A yarn processing system comprising a yarn consuming textile machine, a yarn feeding device disposed upstream of said textile machine and including a winding drive, a rotatable supply spool disposed upstream of said yarn feeding device and positioned relative to said yarn feeding device for a tangential yarn release, said supply spool being rotatable by yarn tension generated during withdrawal of the yarn by said winding drive, a regulating device which varies a yarn releasing rotational resistance of said supply spool, a control arrangement which controls said winding drive to allow the formation of a yarn store on a storage body through withdrawal of yarn from said supply spool, and a yarn sensor disposed to monitor the size of the yarn store and providing signals to said control arrangement which are indicative of the size of the yarn store, the yarn store being of a size sufficient to satisfy a consumption demand of said textile machine but varying in size based upon consumption by said textile machine, said control arrangement additionally controlling said regulating device and permitting communication between a control of said winding drive and a control of said regulating device such that said regulating device varies the rotational resistance of said supply spool substantially in synchronism with speed variations of said winding drive based upon one of: a signal provided by said yarn sensor; and a signal provided by said winding drive control.

12. The yarn processing system of claim 11, wherein said regulating device comprises a braking device which engages and disengages with said supply spool.

13. The yarn processing system of claim 12, wherein said yarn sensor monitors a maximum size of the yarn store and generates a maximum signal, said winding drive control generates a stop signal and switches off actuation current to a drive motor of said winding drive upon occurrence of the maximum signal, said braking device control causing said braking device to engage with said supply spool upon the occurrence of one of: the maximum signal generated by said yarn sensor; and the stop signal generated by said winding drive control.

14. The yarn processing system of claim 13, wherein said yarn feeding device includes a further yarn sensor which monitors a minimum size of the yarn store and which generates a minimum signal, said winding drive control generating a run signal and switching on actuation current to the drive motor of said winding drive upon occurrence of the minimum signal, said braking device control causing said braking device to disengage with said supply spool upon the occurrence of one of: the minimum signal generated by said yarn sensor; and the run signal generated by said winding drive control.

15. The yarn processing system of claim 14, wherein said control arrangement includes an external pick-up head which detects the run or stop signal.

16. The yarn processing system of claim 14, wherein said supply spool includes a braking element fixed thereto, and said braking device includes a pneumatic cylinder and a friction element which acts upon said braking element, said friction element being positionally adjustable between engagement and disengagement positions relative to said braking element by said pneumatic cylinder.

17. The yarn processing system of claim 13, wherein said braking device is engageable with said supply spool with an adjustable delay based upon the occurrence of one of: the maximum signal of said yarn sensor; and the stop signal of said winding drive control.

18. The yarn processing system of claim 11, wherein said regulating device includes a slip rotational drive which is adjustable between a conveying operation mode so as to generate lower driving torque than the torque generated at said supply spool by the yarn tension during withdrawal of the yarn by said winding drive, and a braking operation mode so as to generate a braking torque sufficient to stop said supply spool.

* * * * *